US007841552B2

(12) United States Patent
Frangenberg et al.

(10) Patent No.: US 7,841,552 B2
(45) Date of Patent: Nov. 30, 2010

(54) TWIN-ROLL MACHINE, IN PARTICULAR FOR COMMINUTING A BED OF MATERIAL

(75) Inventors: Meinhard Frangenberg, Kürten-Engeldorf (DE); Alexander Hagedorn, Pulheim (DE)

(73) Assignee: KHD Humboldt Wedag GmbH, Cologne (DE)

( * ) Notice: Subject to any disclaimer, the term of this patent is extended or adjusted under 35 U.S.C. 154(b) by 427 days.

(21) Appl. No.: 12/064,738

(22) PCT Filed: Sep. 16, 2006

(86) PCT No.: PCT/EP2006/009033

§ 371 (c)(1),
(2), (4) Date: Feb. 25, 2008

(87) PCT Pub. No.: WO2007/033800

PCT Pub. Date: Mar. 29, 2007

(65) Prior Publication Data

US 2008/0217451 A1 Sep. 11, 2008

(30) Foreign Application Priority Data

Sep. 22, 2005 (DE) ..... 10 2005 045 273

(51) Int. Cl.
*B02C 18/30* (2006.01)

(52) U.S. Cl. ..... 241/285.2; 241/230; 72/238

(58) Field of Classification Search ..... 241/285.2, 241/230; 72/210, 211, 237, 238
See application file for complete search history.

(56) References Cited

U.S. PATENT DOCUMENTS 344,258 A * 6/1886 Dunne ..... 241/285.1
3,691,809 A * 9/1972 Hlafcsak ..... 72/199
4,251,180 A * 2/1981 Hansen ..... 414/560
4,395,944 A 8/1983 Siepermann et al.
4,471,642 A * 9/1984 Wilson ..... 72/238
4,552,007 A * 11/1985 Mantovan ..... 72/239
4,823,584 A * 4/1989 Haynes ..... 72/225
4,945,746 A * 8/1990 Jakimowicz et al. ..... 72/251
5,524,469 A * 6/1996 Sherwood ..... 72/241.2
7,628,347 B2 * 12/2009 Frangenberg et al. ..... 241/231

FOREIGN PATENT DOCUMENTS

EP 0050342 A2 4/1982
EP 1147815 10/2001
WO WO 2005070549 8/2005

* cited by examiner

*Primary Examiner*—Bena Miller
(74) *Attorney, Agent, or Firm*—Greer, Burns & Crain, Ltd.

(57) ABSTRACT

A two-roll machine has two rolls rotatably mounted in bearing housings, driven in opposite directions and separated from each other by a roll gap. One roll is a loose roll with bearing housings horizontally supported on machine frame side parts by hydraulic cylinders applying a roll pressing force. The other roll is a fixed roll with bearing housings horizontally supported on frame end pieces. The bearing housings are mounted on sliding tracks of two lower-flange and two upper-flange machine brackets. The two-roll machine includes a lower frame adjacent to the fixed roll, the lower frame lengthening the two lower-flange machine brackets. A transverse frame is connected to the two upper-flange machine brackets, the transverse frame having a clear opening width which permits the rolls to be moved through the transverse frame onto the lower frame. The frame end pieces are releasably connected to the lower-flange and upper-flange machine brackets.

20 Claims, 4 Drawing Sheets

TWIN-ROLL MACHINE, IN PARTICULAR FOR COMMINUTING A BED OF MATERIAL

BACKGROUND OF THE INVENTION

The invention relates to a two-roll machine for the pressure treatment of granular material, in particular a roller press for material bed comminution or compaction or briquetting, having two rolls which are rotatably mounted in bearing housings, driven in opposite directions and separated from each other by a roll gap, one of which is formed as a loose roll whose bearing housings are supported on machine frame side parts by hydraulic cylinders applying the roll pressing force, while the bearing housings of the fixed roll are supported on frame end pieces, and all the bearing housings being mounted with their undersides and upper sides on sliding tracks of lower-flange and upper-flange machine brackets.

During roller grinding for performing what is known as material bed comminution, the individual pieces or particles of the ground material drawn into the roll gap by friction, such as cement raw material, cement clinker, ores or the like, are pressed and mutually comminuted in a material bed, that is to say in a material fill pressed together between the two roll surfaces with the application of a high pressure, mention also being made of a roller press instead of a roll mill. In previously known roller presses, see for example the brochure "Rollenpressen" [Roller presses] no. 2-300 d from KHD Humboldt Wedag AG dated September 1994, page 2, one of the two rolls is constructed as a fixed roll, which is supported via its bearing housings against end pieces of the machine frame, while the other roll, as a loose roll, is supported via its bearing housings on hydraulic cylinders, with which the roll pressing force is applied. In this case, the hydraulic cylinders in turn have to be supported on solid side parts of the machine frame, which forms an intrinsically closed force system, that is to say the radial roll pressing forces or grinding forces occurring during the operation of the roller press have to be absorbed by the machine frame.

There is a need on the part of the operators of such roller presses to be able to remove the rolls in the most simple and rapid way possible and re-install them again, for reasons of the repair of worn rolls, etc., for example, for which purpose the machine frame has to be broken down in order to make the rolls accessible in order to change them.

In order to facilitate the roll change in roller presses, it is known, for example brochure "Hochdruckzerkleinerung mit Walzenpressen" [High-pressure comminution with roll presses] from Köppem GmbH & Co. KG dated 7/87, page 6, to construct the press frames as folding frames, by side parts of the machine frame being attached to the ends of the lower flange and upper flange machine brackets via pin hinges. All the pin hinge axes lie parallel to the roll axes, so that the pin hinges are under the full loading of the high roll pressing forces. Therefore, loosening the upper locking pin hinges and actuating the lower pin hinge axes, and folding out the machine frame parts on the end in a horizontal plane can present difficulties before the rolls can then be pulled out onto the folded-out frame parts. In addition, the two rolls cannot be removed towards one side of the roll press.

SUMMARY OF THE INVENTION

The invention is based on the object of designing a two-roll machine, in particular a roller press of the above-mentioned type, in such a way that a roll change can be performed still more simply and more quickly.

In the two-roll machine according to the invention, in particular a roller press for material bed comminution, to the front end of the roller press which is adjacent to the fixed roll, that is to say on the side of the frame end pieces supporting the fixed roll, there is attached an additional frame, specifically a lower frame lengthening the two bracket lower flanges and a transverse frame that is connected to the two upper flanges and has a clear opening width which permits the complete rolls to be pushed through the transverse frame on to the lower frame. To this end, the frame end pieces supporting the fixed roll during roller press operation can be released from their connection to the bracket lower flanges and bracket upper flanges for the purpose of the roll change, to be specific can be folded out laterally upwards by means of hydraulic cylinders. In this case, according to a further feature of the invention, the pivot axes for folding out, in particular pivoting upwards, the machine frame end pieces are arranged at right angles to the roll axes; the pivoting joints are therefore not loaded by the roll pressing force.

The upper crossmember of the attached transverse frame supports the open ends of the two bracket upper flanges. Using a suitable pulling apparatus, for example using a double cable winch having two pull cables which run around reversibly, are arranged transversely with respect to the roll gap and can be coupled to the rolls, after the machine frame end pieces have been folded out, the two rolls together with their bearing housings can be pulled successively out of the roller press onto the lower frame of the additional frame and, conversely, new or repaired rolls can be pulled into the roller press from the additional frame. After the two rolls have been pulled out horizontally onto the attached additional frame, the rolls can be removed vertically, for example, and transported further, for example with the use in particular of a mobile crane, etc.

In the two-roll machine according to the invention, a simple and rapid roll change can be brought about without in the process any kind of pin hinges having to be released, unlocked and locked. Complicated disassembly work on the machine frame is not needed. In order to minimize changeover times, the attached additional frame remains permanently mounted.

According to a further feature of the invention, the hydraulic cylinders which are used to fold out, in particular pivot upwards, the machine frame end pieces and act on the latter are advantageously attached to the transverse frame of the additional frame. According to a further feature of the invention, before the rolls are pulled out of the machine frame, the protective covering of at least one roll can be pivoted downwards or upwards, in each case about a pivot axis parallel to the roll axes.

The frame end pieces which support the fixed roll during press operation and can be folded out upwards, when they are not in their folded out position, can be latched into lateral vertical grooves in the lower flange and upper flange machine brackets, which accommodate the profile cross section of the folding frame end pieces. In this case, before the frame end pieces are folded or pivoted, pin hinges which are not loaded with any kind of forces have to be released.

BRIEF DESCRIPTION OF THE DRAWINGS

The invention and its further features and developments will be explained in more detail using exemplary embodiments illustrated schematically in the figures.

DETAILED DESCRIPTION OF THE PREFERRED EMBODIMENTS

Figure 1:
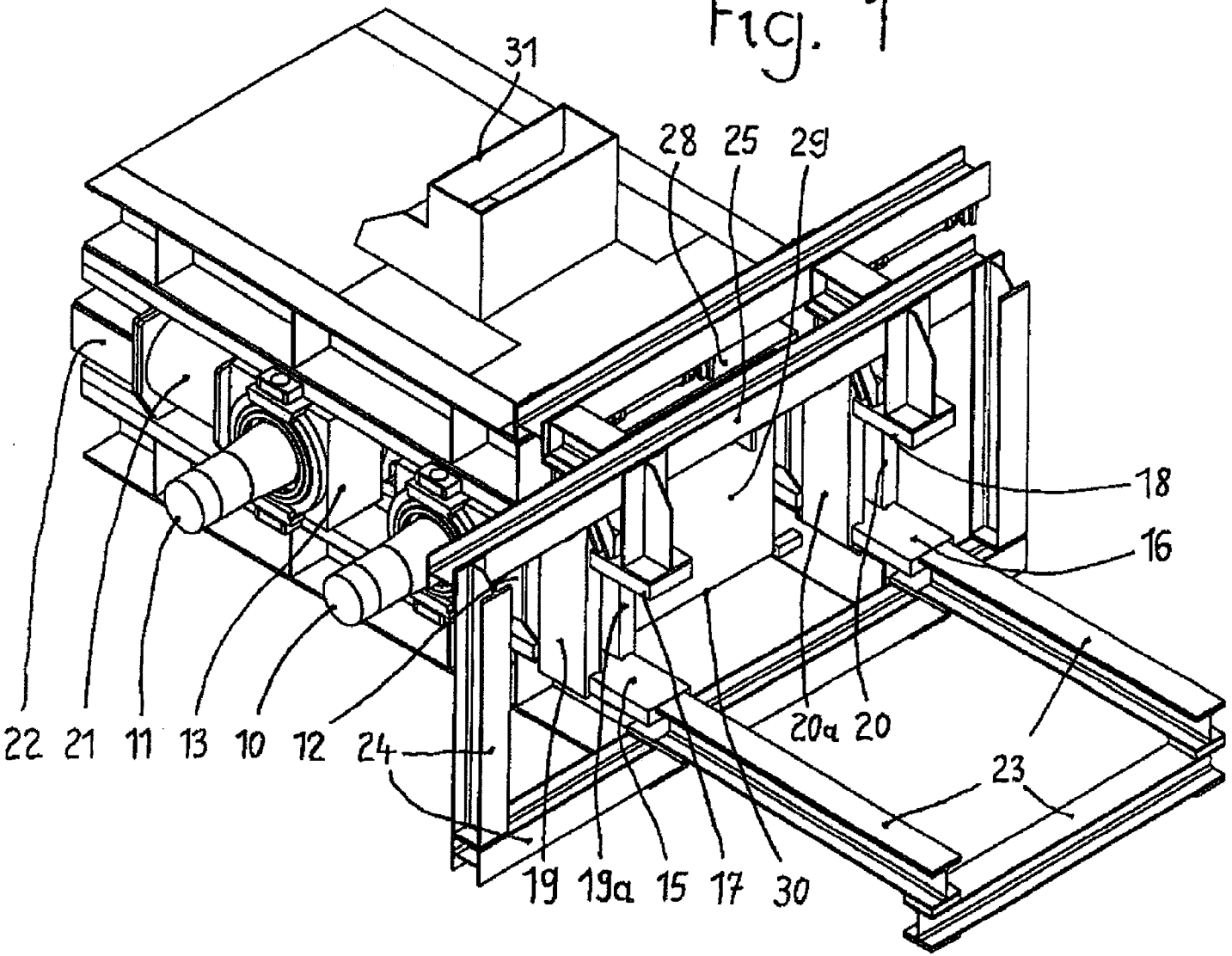
FIG. 1 shows a perspective view of the roller press according to the invention with attached additional frame for purposes of simplifying the changing of the two rolls.
Figure 2:
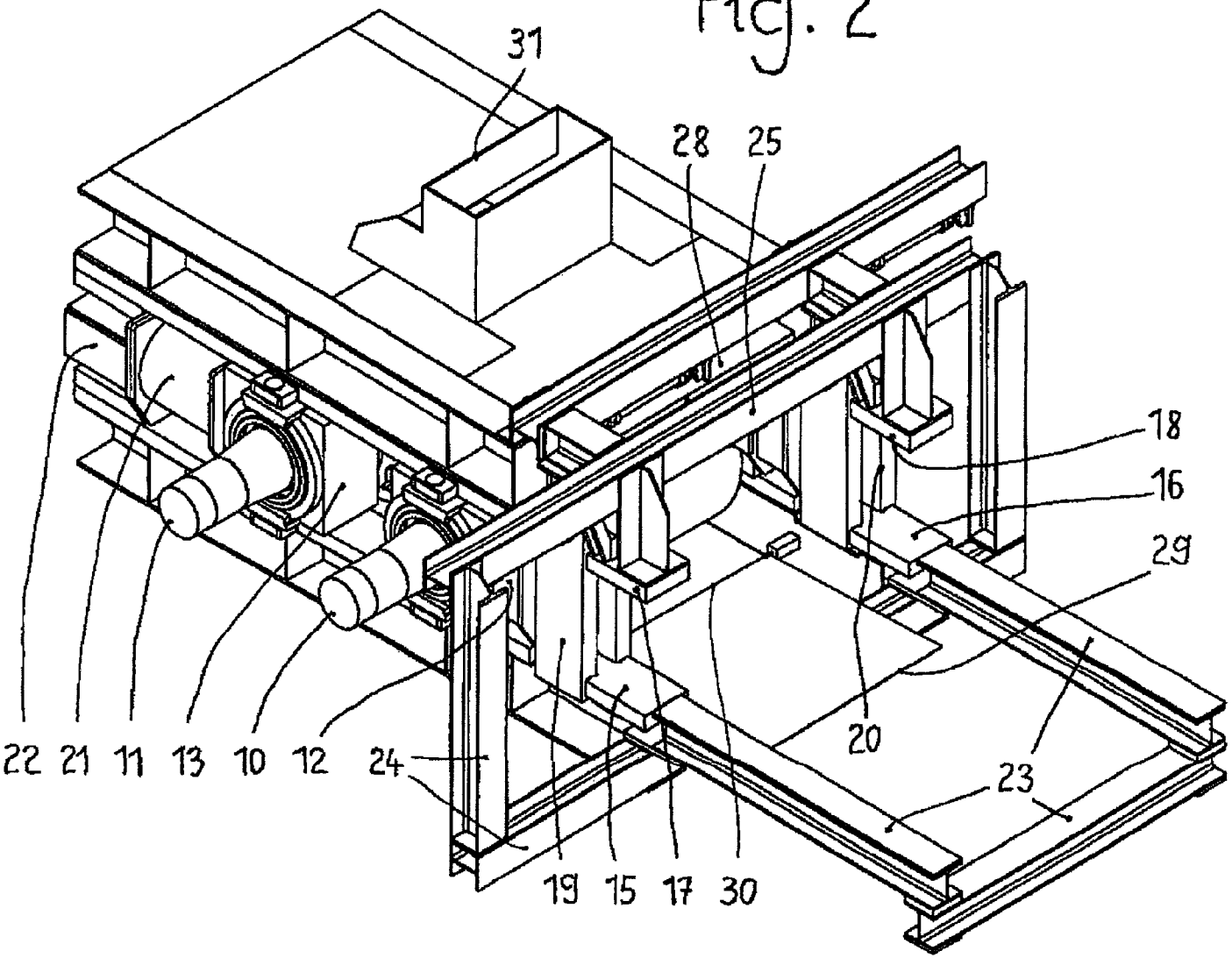
FIG. 2 shows the roller press of FIG. 1, likewise in a perspective view, with the protective covering of the right-hand roll folded out downwards.

The roller press illustrated in the figures for the material bed comminution of granular material has two rolls 10, 11 that can be rotated in opposite directions and have drive journals arranged on the left-hand side. The rolls are separated from each other by a roll gap and are mounted in bearing housings, of which the bearing housing 12 of the right-hand roll 10 and the bearing housing 13 of the left-hand roll 11 can be seen. All the bearing housings 12, 13 can be moved with their undersides and upper sides such that they can slide transversely with respect to the roll gap on sliding tracks of machine bracket lower flanges 15, 16 and upper flanges 17, 18 by means of sliding plates, of which the upper sliding plates 14 of the bearing housing 13 can be seen in FIG. 4.

In the exemplary embodiment in the drawing, the right-hand roll 10 is constructed as a fixed roll, whose bearing housings 12 are supported on vertical machine frame end pieces 19, 19*a*, 20, 20*a*, while the other roll 11 is constructed as a loose roll, whose bearing housings 13 are supported on machine frame side parts 22 via hydraulic cylinders 21 applying the roll pressing force.

According to the invention, to the end of the roller press adjacent to the fixed roll 10 there is attached an additional frame, specifically a lower frame 23 lengthening the two lower flanges 15, 16, and at least one transverse frame 24 connected to the two upper flanges 17, 18 and having a clear width which permits the rolls to be pushed through onto the lower frame 23 through this transverse frame 24. The level of the sliding tracks of the lower frame 23 is at the height of the sliding tracks of the lower flanges 15, 16.

Figure 3:
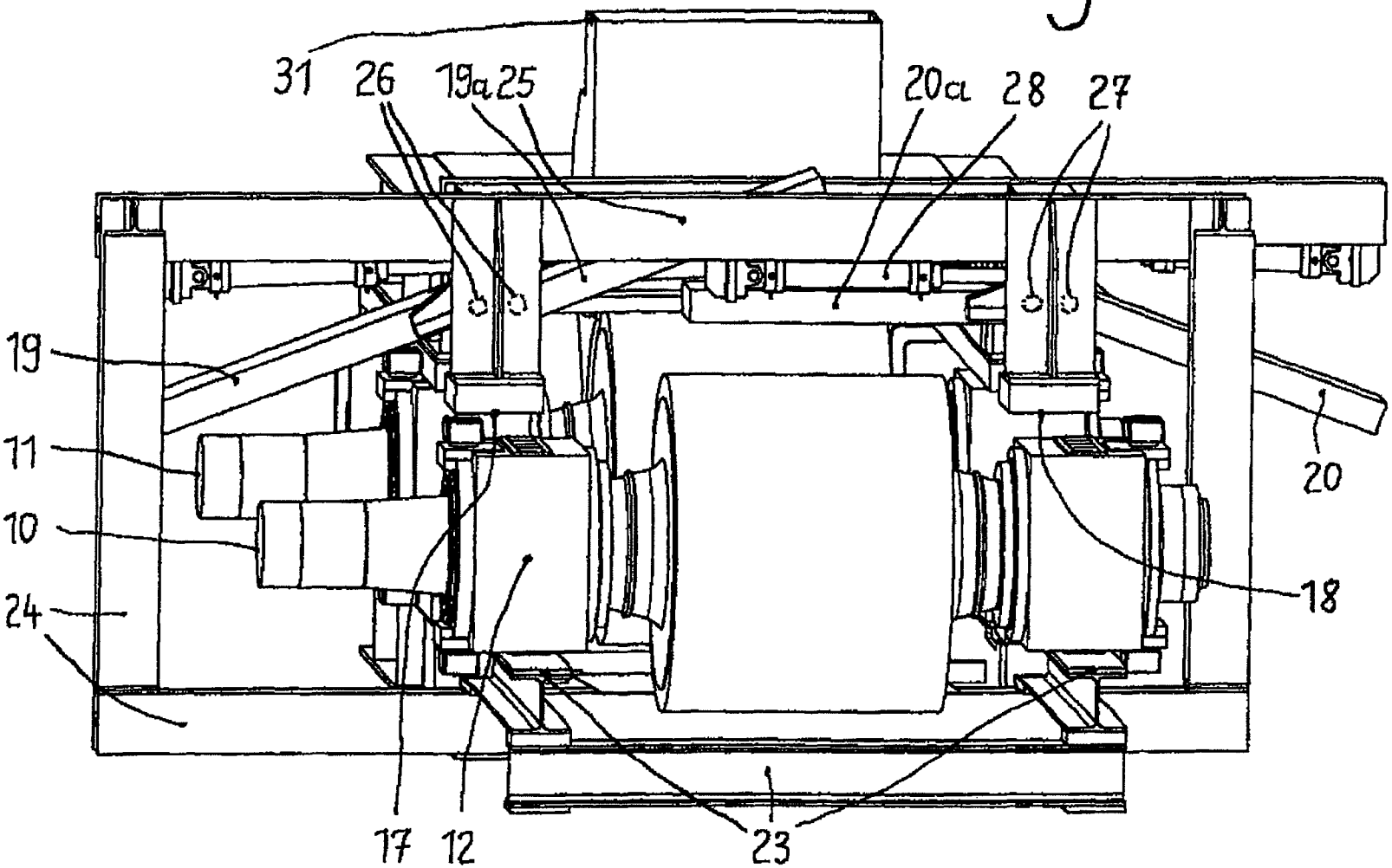
FIG. 3 shows, seen in more of an end view, the roller press with the machine frame end pieces folded upwards and with the right-hand roll already pulled out by the attached additional frame.
Figure 4:
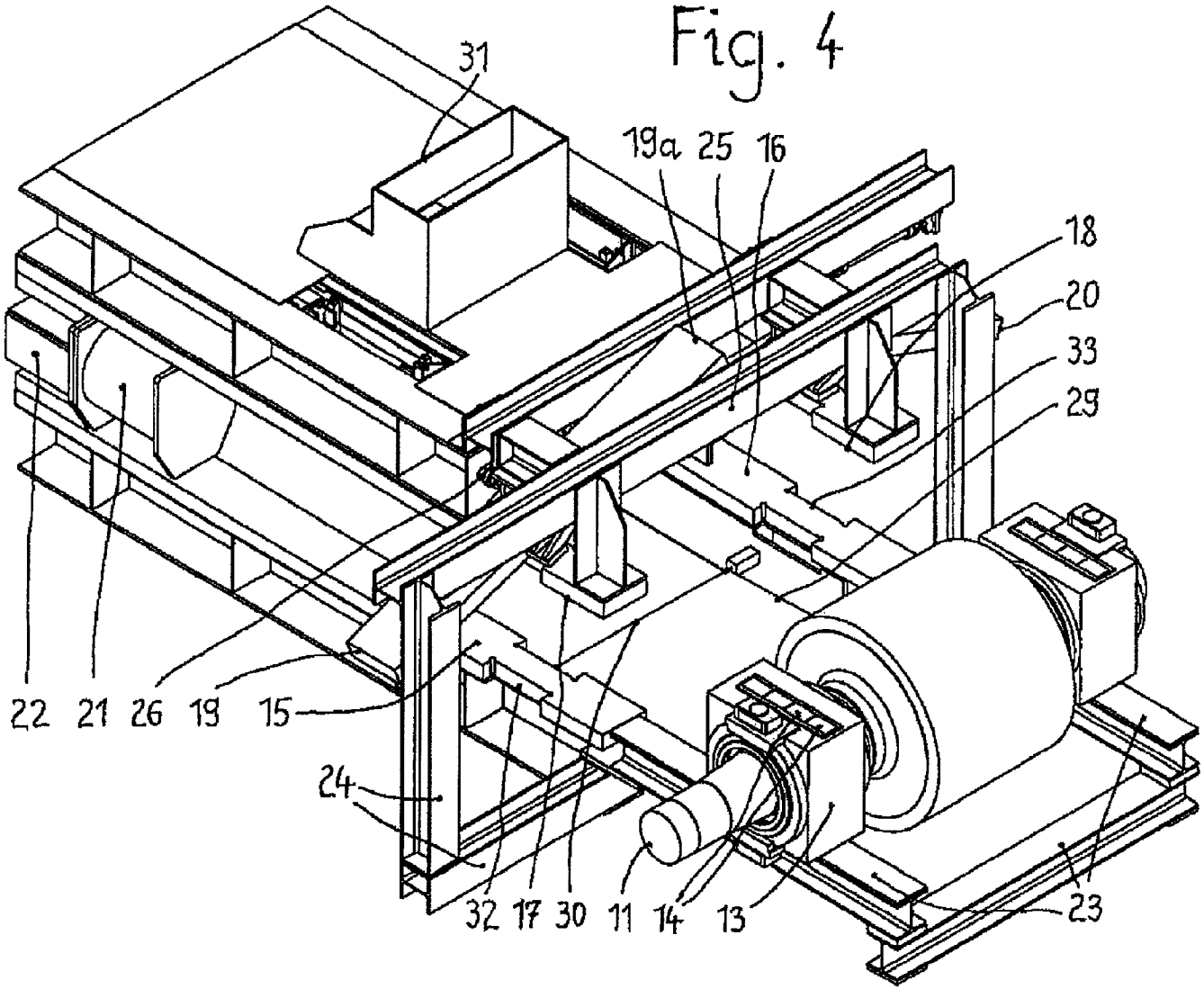
FIG. 4 shows the roller press with the right-hand roll already removed and with the left-hand roll pulled out towards the same end through the transverse frame of the additional frame onto the lower frame of the latter.

For the purpose of the roll change, the frame end pieces 19, 19*a*, 20, 20*a* supporting the fixed roll 10 during roller press operation can be released from their connection to the bracket upper flanges 15, 16 and lower flanges 17, 18, in particular by these end pieces being pivoted laterally upwards, as can be seen in FIGS. 3 and 4. The transverse frame 24 has an upper crossmember 25, on which the open ends of the two bracket upper flanges 17, 18 are suspended. Using a suitable pulling apparatus, after the machine frame end pieces 19, 19*a*, 20, 20*a* have been folded up, the two rolls 10, 11 together with their bearing housings can be pulled successively out of the roller press towards one side onto the lower frame 23 of the additional frame and, conversely, can be pulled from the additional frame into the roller press. After the two rolls have been pulled out horizontally onto the attached lower frame 23, the rolls can be removed conveniently, for example vertically, and transported onwards, for example by a mobile crane.

The frame end pieces 19, 19*a*, 20, 20*a* can be folded out of their vertical position about pivot axes which are arranged in the transverse frame 24 at right angles to the roll axes. Such pivot axes 26, 27 are indicated in FIGS. 3 and 4. In order to fold out, in particular pivot upwards, the end pieces 19, 19*a*, 20, 20*a*, hydraulic cylinders 28 are provided, which are attached to the transverse frame 24 of the additional frame, lying in vertical planes parallel to the roll axes.

Before the rolls are pulled out of the machine frame, the protective covering 29 of at least the fixed roll 10 is pivoted downwards into a horizontal position about a pivot axis 30 parallel to the roll axis. However, instead of being pivoted downwards, the protective covering 29 could also be pivoted upwards. Furthermore, before the two rolls are pulled out of the machine frame, the roll end covers are removed from the machine frame with the side wall points at the top. The removed state of these machine parts can be seen in FIG. 4. It is worth noting that the material feed hopper 31 does not have to be removed or moved for the purpose of the roll change.

FIG. 4 clearly reveals that the frame end pieces 19, 19*a*, 20, 20*a* which support the fixed roll 10 during roller press operation and can be folded out upwards, when they are not in their folded out position, that is to say in the vertical working position, can be latched into lateral vertical grooves 32, 33 which accommodate the profile cross section of the folding frame end pieces 19, 19*a*, 20, 20*a*, so that the frame end pieces 19, 19*a*, 20, 20*a* can absorb the radial roll pressing forces safely. Furthermore, FIG. 4 also reveals that the two machine frame end pieces supporting the fixed roll 10 can each be assembled from two halves, 19, 19*a*, 20, 20*a*, which can each be folded out of their vertical plane in mirror-image fashion in relation to each other. In this exemplary embodiment, four pivotable frame end pieces, in each case four vertical grooves machined into the lower flange and upper flange, and four hydraulic pivoting cylinders are required in order to actuate all the frame end pieces that can be pivoted out. In principle, however, it would also be possible to manage with only two frame end pieces 19 and 20 that can be pivoted up outwards.

In the roller press according to the invention, in order to simplify the roll change, the attached additional frame could also be attached to the end of the machine adjacent to the loose roll 11 instead of to the end of the machine adjacent to the fixed roll 10.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A two-roll machine for the pressure treatment of granular material, having two rolls which are rotatably mounted in bearing housings, driven in opposite directions and separated from each other by a roll gap, one of which is formed as a loose roll whose bearing housings are supported on machine frame side parts by hydraulic cylinders applying a roll pressing force, while the other is formed as a fixed roll whose bearing housings are supported on frame end pieces, and all of the bearing housings being mounted with their undersides and upper sides on sliding tracks of two lower-flange and two upper-flange machine brackets, comprising:

an additional frame in the form of a lower frame at a front end of the roller press adjacent to the fixed roll, the lower frame lengthening the two lower-flange machine brackets and a transverse frame connected to the two upper-flange machine brackets, the transverse frame having a clear opening width which permits the rolls to be pushed through the transverse frame onto the lower frame, the frame end pieces supporting the fixed roll during roller press operation releasably connected to the lower-flange machine brackets and upper-flange machine brackets, an upper crossmember of the transverse frame supporting the open ends of the two bracket upper flanges, and a pulling apparatus arranged to pull the two rolls, together with bearing housings, successively out of the roller press to one side onto the lower frame of the additional frame after the machine frame end pieces have been released and, to pull the two rolls, together with bearing housings, into the roller press from the additional frame.

2. A two-roll machine according to claim 1, wherein the frame end pieces are arranged to be folded out about pivot axes which are positioned in the transverse frame at right angles to the roll axes.

3. A two-roll machine according to claim 2, wherein hydraulic cylinders attached to the transverse frame of the additional frame and lying in vertical planes parallel to the roll axes are provided which are used to fold out the machine frame end pieces.

4. A two-roll machine according to claim 3, wherein the hydraulic cylinders are arranged to pivot the machine frame end pieces upwards.

5. A two-roll machine according to claim 2, wherein the machine frame end pieces supporting the fixed roll are each assembled from two halves which can each be folded out of their vertical plane in mirror-image fashion in relation to each other.

6. A two-roll machine according to claim 1, including a protective covering for at least the fixed roll which is arranged to be pivoted about a pivot axis.

7. A two-roll machine according to claim 6, wherein, the protective covering is arranged to be pivoted downwards about the pivot axis which is oriented parallel to the roll axis.

8. A two-roll machine according to claim 6, wherein, the protective covering is arranged to be pivoted upwards about the pivot axis which is oriented parallel to the roll axis.

9. A two-roll machine according to claim 1, including roll end covers arranged to be removed from the machine frame by means of side wall points at a top.

10. A two-roll machine according to claim 1, including lateral vertical grooves in the lower-flange machine brackets and upper-flange machine brackets, which accommodate a profile cross section of the frame end pieces.

11. A two-roll machine according to claim 1, wherein the pulling apparatus has two pull cables which run around reversibly, are arranged transversely with respect to the roll gap and can be coupled to one of the rolls and its bearing housings in order to pull the rolls out and in.

12. A two-roll machine for the pressure treatment of granular material, having two rolls which are rotatably mounted in bearing housings, driven in opposite directions and separated from each other by a roll gap, one of which is formed as a loose roll whose bearing housings are horizontally supported on machine frame side parts by hydraulic cylinders applying a roll pressing force, while the other is formed as a fixed roll whose bearing housings are horizontally supported on frame end pieces, and all of the bearing housings being mounted with their undersides and upper sides on sliding tracks of two lower-flange and two upper-flange machine brackets, comprising:

a lower frame at an end of the roller press adjacent to the fixed roll, the lower frame lengthening the two lower-flange machine brackets, a transverse frame connected to the two upper-flange machine brackets, the transverse frame having a clear opening width which permits the rolls to be pushed through the transverse frame onto the lower frame, the frame end pieces horizontally supporting the fixed roll during roller press operation being releasably connected to the lower-flange machine brackets and upper-flange machine brackets, an upper crossmember of the transverse frame supporting the open ends of the two bracket upper flanges, and a pulling apparatus arranged to pull the two rolls, together with bearing housings, successively out of the roller press to one side onto the lower frame of the additional frame after the machine frame end pieces have been released and, to pull the two rolls, together with bearing housings, into the roller press from the additional frame.

13. A two-roll machine according to claim 12, wherein the frame end pieces are arranged to be folded out about pivot axes which are positioned in the transverse frame at right angles to the roll axes.

14. A two-roll machine according to claim 13, wherein hydraulic cylinders attached to the transverse frame of the additional frame and lying in vertical planes parallel to the roll axes are provided which are used to fold out the machine frame end pieces.

15. A two-roll machine according to claim 13, wherein the machine frame end pieces supporting the fixed roll are each assembled from two halves which can each be folded out of their vertical plane in mirror-image fashion in relation to each other.

16. A two-roll machine according to claim 12, including a protective covering for at least the fixed roll which is arranged to be pivoted about a pivot axis.

17. A two-roll machine according to claim 12, including roll end covers arranged to be removed from the machine frame.

18. A two-roll machine according to claim 12, including lateral vertical grooves in the lower-flange machine brackets and upper-flange machine brackets, which accommodate a profile cross section of the frame end pieces.

19. A two-roll machine according to claim 12, wherein the pulling apparatus has two pull cables which run around reversibly, are arranged transversely with respect to the roll gap and can be coupled to one of the rolls and its bearing housings in order to pull the rolls out and in.

20. A two-roll machine for the pressure treatment of granular material, comprising:

two rolls rotatably mounted in bearing housings, driven in opposite directions and separated from each other by a roll gap, a first one of the rolls being a loose roll with bearing housings horizontally supported on machine frame side parts by hydraulic cylinders applying a roll pressing force, a second one of the rolls being a fixed roll with bearing housings horizontally supported on frame end pieces, all of the bearing housings being mounted with their undersides and upper sides on sliding tracks of two lower-flange and two upper-flange machine brackets, a lower frame adjacent to the fixed roll, the lower frame lengthening the two lower-flange machine brackets, a transverse frame connected to the two upper-flange machine brackets, the transverse frame having a clear opening width which permits the rolls to be moved through the transverse frame onto the lower frame, and the frame end pieces horizontally supporting the fixed roll during roller press operation being releasably connected to the lower-flange machine brackets and upper-flange machine brackets.

* * * * *